US011524418B2

(12) United States Patent
Athanassiou et al.

(10) Patent No.: US 11,524,418 B2
(45) Date of Patent: Dec. 13, 2022

(54) SHAVING BLADE ASSEMBLY

(71) Applicant: BIC VIOLEX S.A., Anoixi (GR)

(72) Inventors: Dionysios Athanassiou, Athens (GR); Panagiotis Moustakas, Athens (GR)

(73) Assignee: BIC Violex Single Member S.A., Anoixi (GR)

( * ) Notice: Subject to any disclaimer, the term of this patent is extended or adjusted under 35 U.S.C. 154(b) by 74 days.

(21) Appl. No.: 16/962,727

(22) PCT Filed: Dec. 20, 2018

(86) PCT No.: PCT/EP2018/086366
§ 371 (c)(1),
(2) Date: Jul. 16, 2020

(87) PCT Pub. No.: WO2019/141487
PCT Pub. Date: Jul. 25, 2019

(65) Prior Publication Data

US 2020/0353633 A1 Nov. 12, 2020

(30) Foreign Application Priority Data

Jan. 17, 2018 (EP) ..... 18152164

(51) Int. Cl.
*B26B 21/22* (2006.01)
*B26B 21/40* (2006.01)

(52) U.S. Cl.
CPC ..... *B26B 21/227* (2013.01); *B26B 21/4018* (2013.01); *B26B 21/225* (2013.01); *B26B 21/4031* (2013.01); *B26B 21/4068* (2013.01)

(58) Field of Classification Search
CPC ..... B26B 21/14; B26B 21/16; B26B 21/22; B26B 21/225; B26B 21/227; B26B 21/40;
(Continued)

(56) References Cited

U.S. PATENT DOCUMENTS 2,691,217 A * 10/1954 Clark ..... B26B 21/00 30/50
3,667,121 A 6/1972 Dorion
(Continued)

FOREIGN PATENT DOCUMENTS

CN 1270548 A 10/2000
CN 201446542 U 5/2010
(Continued)

OTHER PUBLICATIONS

International Search Report And Written Opinion in PCT/EP2018/086366 dated Apr. 1, 2019 (9 pages).
(Continued)

*Primary Examiner* — Jason Daniel Prone
(74) *Attorney, Agent, or Firm* — Bookoff McAndrews, PLLC

(57) ABSTRACT

A shaving blade assembly and a method of using a shaving blade assembly may include a blade, a first resilient element, and a first movable member. The first resilient element may support the blade and be arranged to urge the blade in a first direction substantially orthogonal to a cutting edge of the blade. The first movable member may selectively engage the first resilient element, in the first direction in at least one position, to impede deformation of the first resilient element.

20 Claims, 3 Drawing Sheets

(58) Field of Classification Search
CPC ..... B26B 21/4012; B26B 21/4018; B26B 21/4025; B26B 21/4031; B26B 21/4062; B26B 21/4068
USPC ..... 30/47–51
See application file for complete search history.

(56) References Cited

U.S. PATENT DOCUMENTS 3,852,880 A * 12/1974 Braginetz ..... B26B 21/18 30/74.1
3,955,277 A 5/1976 Pomfret
4,257,160 A * 3/1981 Murai ..... B26B 21/4062 30/50
4,345,374 A 8/1982 Jacobson
4,501,067 A * 2/1985 Duncan ..... B26B 21/4062 30/47
4,774,765 A * 10/1988 Ferraro ..... B26B 21/227 30/50
4,939,840 A * 7/1990 Butka ..... B26B 21/227 30/50
5,005,288 A * 4/1991 Wilk ..... B26B 21/4062 30/41
5,253,420 A * 10/1993 Althaus ..... B26B 21/227 30/47
5,313,706 A 5/1994 Motta
5,715,606 A * 2/1998 de Wolf ..... B26B 21/227 30/48
6,425,184 B1 * 7/2002 Min ..... B26B 21/225 30/51
8,024,863 B2 * 9/2011 Wain ..... B26B 21/227 30/50
8,689,448 B2 * 4/2014 Ren ..... B26B 21/4012 30/50
10,464,226 B2 * 11/2019 Bozikis ..... B26B 21/227
10,583,575 B2 * 3/2020 Ntavos ..... B26B 21/4012
10,639,806 B2 * 5/2020 Bozikis ..... B26B 21/227
10,744,662 B2 * 8/2020 Bozikis ..... B26B 21/4068
10,751,894 B2 * 8/2020 Georgakis ..... B26B 21/4018
10,800,056 B2 * 10/2020 Kim ..... B26B 21/4012
10,836,059 B2 * 11/2020 Efthimiadis ..... B26B 21/227
10,946,540 B2 * 3/2021 Bozikis ..... B26B 21/227
11,084,179 B2 * 8/2021 Panagiotopoulou .... B26B 19/40
11,090,824 B2 * 8/2021 Bozikis ..... B26B 21/4025
11,090,825 B2 * 8/2021 Bozikis ..... B26B 21/4018
11,117,277 B2 * 9/2021 Bozikis ..... B26B 21/227
11,148,310 B2 * 10/2021 Maimone ..... B26B 21/225
11,224,982 B2 * 1/2022 Efthimiadis ..... B26B 21/4068
2003/0213130 A1 * 11/2003 Motta ..... B26B 21/225 30/50
2004/0020053 A1 * 2/2004 Wain ..... B26B 21/227 30/49
2011/0289779 A1 * 12/2011 Volodin ..... B26B 21/227 30/50
2012/0151775 A1 6/2012 Ren
2012/0210586 A1 * 8/2012 Lelieveld ..... B26B 21/225 30/527
2016/0346944 A1 12/2016 Sadrialaei
2020/0346357 A1 * 11/2020 Skodras ..... B26B 21/225
2020/0346359 A1 * 11/2020 Saltas ..... B26B 21/4025
2021/0031389 A1 * 2/2021 Bozikis ..... B26B 21/4031
2021/0213630 A1 * 7/2021 Chatzigrigoriou ..... B26B 21/4031
2021/0245377 A1 * 8/2021 Paspatis ..... B26B 21/4062
2021/0362360 A1 * 11/2021 Chatzigrigoriou .... B26B 21/227
2021/0362361 A1 * 11/2021 Chatzigrigoriou .... B26B 21/227
2021/0394381 A1 * 12/2021 Bozikis ..... B26B 21/4068

FOREIGN PATENT DOCUMENTS

DE 10 2004 020 650 A1 11/2005
EP 3858565 A1 * 8/2021 ..... B26B 21/227
GB 190806476 A 5/1909
WO 9904938 A1 2/1999
WO WO 01/39937 A1 6/2001
WO WO 2011/042842 A1 4/2011

OTHER PUBLICATIONS

Chinese search report in corresponding Chinese Application No. 201880078388, dated Jul. 13, 2021 (1 page).

* cited by examiner

SHAVING BLADE ASSEMBLY

This application is a National Stage Application of International Application No. PCT/EP2018/086366, filed on Dec. 20, 2018, now published as WO2019/141487 and which claims the priority benefit of European Patent Application number EP18152164.2 filed on Jan. 17, 2018.

TECHNICAL FIELD

The present description relates to a shaving blade assembly, and more specifically, to a shaving blade assembly comprising a blade, a first resilient element supporting the blade and arranged to urge the blade in a first direction orthogonal to the cutting edge of the blade; and a first movable member configured to engage the first resilient element in the first direction and be secured in at least one position to impede deformation of the first resilient element. The shaving blade assembly may be specifically adapted for shaving facial, head, and/or body hair. The shaving blade assembly may further include a housing with an upper stop against which the resilient element may urge the blade in the first direction and may be adapted to be attached to a razor handle, possibly interchangeably, in particular when a razor blade or blades of the shaving blade assembly has been blunted.

DESCRIPTION OF RELATED ART

Shaving heads or blade retainers comprising a plurality of blades with adjustable exposure mechanisms are commonly known in the art. For example, U.S. Patent Application Publication number 2016/0346944 A1 discloses blade retaining means that adjust the blade exposure by moving the blades toward and away from the shaving plane. The blades of the multi-blade razor are coupled to a rotating mechanism which is turned into a cleaning position that is substantially perpendicular to the shaving plane.

Similarly, U.S. Pat. No. 5,313,706 discloses a shaving head wherein a pivoting blade arrangement is adapted to decrease the blade exposure while increasing the guard blade span and the shaving angle when the blade is subjected to forces during shaving. In this disclosure, the blades are also adjusted by rotating the blades relative to the shaving plane.

U.S. Pat. No. 4,345,374 discloses a razor blade unit that has a blade member, a guard member located forward of the exposed edge of the blade member, and an integral adjusting mechanism operable independently of the razor handle for changing the positioning of the blade and guard members relative to one another to vary the shaving geometry. The adjustment mechanism is located to the rear of the blade member, on the opposite side of the blade unit from the guard structure. In this disclosure, the exposure of the blades is adjusted by rotating the guard member relative to the shaving plane.

U.S. Pat. No. 3,955,277 discloses a razor blade unit having an adjusting mechanism integral with the blade unit for changing the relative positioning of the blade member and guard portion to vary the shaving geometry of the blade unit. A lever is located on the shaving head. In this disclosure, the exposure of the blades is adjusted by moving the guard member relative to the shaving plane.

Additionally, U.S. Pat. No. 3,667,121 discloses a razor including a handle portion in which there is a mounting means for adjusting the blade exposure by moving the guard bar in different positions. However, in this patent, the guard bar is being adjusted rather than the blades themselves.

In another example, German Patent Application Publication number DE 10 2004 020 650 A1 includes a semi-circled lever that is located on the blade retainers. In this disclosure, the head of the razor is adjusted by rotating a lever around an asymmetrically positioned axle. The angle of the blades can be adjusted with sliding elements assembled on a rail and is moved by an arrangement of toothed wheels. However, the blades are adjusted by rotating the blades relative to the shaving plane.

SUMMARY

Object of the present disclosure is to provide a shaving blade assembly having at least one blade supported on at least one resilient element, and a mechanism that impedes the lateral movement of the at least one blade by applying a pressure on the at least one resilient element. In other words, the mechanism is capable of limiting the displacement of the at least one resilient element or locking the resilient element in place. Another benefit is that the user may adjust the blade geometry without the use of a tool and at any time before, after, or during the shaving process. Another object of the present disclosure is to allow the user to switch from a movable blade head to a fixed blade head.

Aspects of the present disclosure relate to providing a shaving blade assembly comprising: a blade, a first resilient element supporting the blade and arranged to urge the blade in a first direction substantially orthogonal to the cutting edge of the blade; and a first movable member configured to selectively engage the first resilient element in the first direction, in at least one position, to impede deformation of the first resilient element.

With this configuration, the shaving blade assembly can selectively adjust the stiffness and/or deformation range of the resilient element based on a user's choice and desire, thus restricting the displacement of the blade, effectively adjusting how far the blade retracts into a housing of the blade assembly in response to a given pressure on their outer surface. Thus, if a user desires an aggressive or precision shave, the user has the option to restrict the deformation of the resilient element to impede the blade from retracting into the housing of the blade assembly under the shaving pressure. The maximum force seen against the skin may be of about 0-0.4 N, more specifically 0.3 N.

Accordingly, in at least one aspect, the shaving blade assembly may further comprise a plurality of blades. Including more blades increases the cutting surface area, reduces the time spent on shaving and minimizes the nicks and cuts.

Accordingly, in at least one aspect, the shaving blade assembly may further comprise a plurality of resilient elements each supporting at least one blade. Including a plurality of resilient elements helps ensure that the blade(s) are positioned in a manner to provide a consistent cut.

Accordingly, in at least one aspect of the shaving blade assembly, the first movable member may be configured to be selectively held in the at least one position. With this configuration, the shaving blade assembly may restrict the movement of the resilient element to a desired range, effectively controlling how far the blade retracts into the housing of the blade assembly.

Accordingly, in at least one aspect of the shaving blade assembly, the first movable member may be configured to be secured in a plurality of different positions. A consequence of the first moveable member being permitted to be securable in a plurality of positions is that the user has the option to adjust the stiffness and/or deformation range of the resilient element.

Accordingly, in at least one aspect, the shaving blade assembly may further comprising a detent mechanism for securing the first movable member in the at least one position. The detent mechanism can be one of any suitable detent mechanisms, including, but not limited to: a spring loaded ball-lock mechanism with matching cavities or a protuberance and corresponding recesses. The detent mechanism allows the movable member to be secured into place in order to avoid accidental movement or release of the blade while shaving.

Accordingly, in at least one aspect of the shaving blade assembly, the first movable member may be configured to be secured by friction in the at least one position. Similar to the detent mechanism, the first movable member can be held into place by any frictional elements, including, but not limited to mating textured surfaces. The frictional contact holding the movable member in place allows the movable member to be secured, thereby avoiding unwanted movement of the blade while shaving.

Accordingly, in at least one aspect, the shaving blade assembly may further comprise a first stiffening member configured to urge the first movable member against the first resilient element. Restricting the movement of the movable member to a desired range restricts the displacement of the blade, effectively controlling how far the blade retracts into a housing of the blade assembly. If a user does not desire a bold shave and also does not desire a sensitive shave, the user has the option to restrict the movement of the resilient element to have a moderate shave. The stiffening member is adapted to urge the movable member to be in continuous contact with the first resilient element which allows for a smooth and consistent shave.

Accordingly, in at least one aspect of the shaving blade assembly, the stiffening member is removably attached. Configuring the shaving assembly to have an interchangeable stiffening member may make the shaving blade assembly more versatile. This is because the interchangeable stiffening members provides a user with greater control over achieving their desired shave. For example, they may insert a stiffening member with a high stiffness k for an aggressive shave, or remove or replace the stiffening member with ones that have a lower stiffness k for a more sensitive shave.

Accordingly, in at least one aspect of the shaving blade assembly, extending between first and second ends in a direction parallel to a cutting edge of the blade, the first movable member being located at the first end and a second movable member being located at the second end, the second movable member being configured to engage a second resilient element in the first direction to impede movement of the second resilient element.

Including a second movable member being configured to engage a second resilient element in the first direction to impede movement of the second resilient element can ensure that the lateral displacement of the entire blade moves within the desired range thereby providing a consistent distance from the shaving surface.

Accordingly, in at least one aspect of the shaving blade assembly, at least one movable member comprises a substantially arcuate segment. The arcuate segment makes it possible to fit the movable member in the interior of a housing of the shaving blade assembly. Having the movable member inside of the housing protects the movable member from being dislodged or toggled inadvertently. Additionally, the arcuate form allows for a larger and more precise range that the resilient elements can move.

Accordingly, in at least one aspect of the shaving blade assembly, at least one resilient element is resilient in bending. Consequently, the flexibility of the resilient element permits the blade to be movable, allowing the blade to better follow the natural contours of the user's body, as well as ensure that the resilient element is durable and has a long life.

Another aspect of the present disclosure relates to providing a method of adjusting a shaving blade assembly, wherein the shaving blade assembly comprises a blade supported by a first resilient element urging the blade in a first direction substantially orthogonal to a cutting edge of the blade; and a first movable member engages the first resilient element in the first direction to impede movement of the first resilient element, wherein the method may include: moving the first movable member from an initial position to a final position in either one of the first or a second direction.

With this configuration, the user can adjust return force of the blade to avoid irritation (e.g., in case of sensitive skin). Additionally, the user may adjust the blade geometry without the use of a separate tool and at any time before, after, or during the shaving process.

Accordingly, in at least one aspect, the first movable member may move along an arcuate path when moved between the initial and final positions. The arcuate path may make it easier to fit the movable member in the interior of a housing of the shaving blade assembly. Having the movable member inside of the housing protects the movable member from being dislodged or toggled inadvertently. Additionally, the arcuate form allows for a larger and more precise range that the resilient elements can move.

The above summary is not intended to describe each and every implementation of the concept. In particular, selected features of any illustrative embodiment within this disclosure may be incorporated into additional embodiments unless clearly stated to the contrary.

BRIEF DESCRIPTION OF THE DRAWINGS

The disclosure may be more completely understood in consideration of the following detailed description of aspects of the disclosure in connection with the accompanying drawings, in which.

Figure 1:
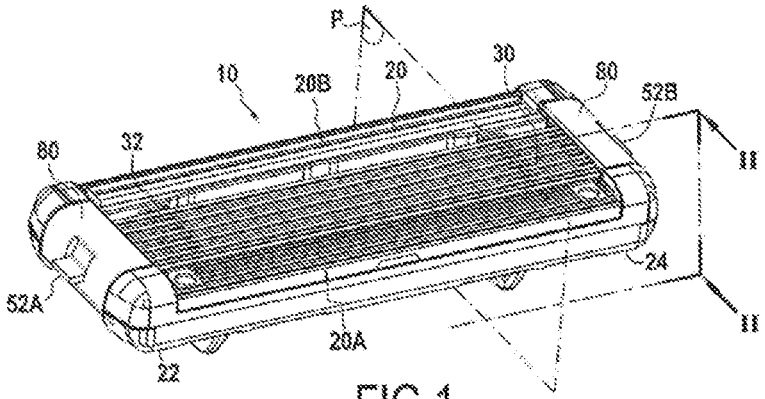
FIG. 1 is a perspective view of a shaving blade assembly according to a first example.

While aspects of the disclosure are amenable to various modifications and alternative forms, specifics thereof have been shown by way of example in the drawings and will be described in detail. It should be understood, however, that the intention is not to limit aspects of the disclosure to the particular embodiment described. On the contrary, the intention of this disclosure is to cover all modifications, equivalents, and alternatives falling within the scope of the disclosure.

DETAILED DESCRIPTION

As used in this disclosure and the appended claims, the singular forms "a", "an", and "the" include plural referents unless the content clearly dictates otherwise. As used in this disclosure and the appended claims, the term "or" is generally employed in its sense including "and/or" unless the content clearly dictates otherwise.

The following detailed description should be read with reference to the drawings. The detailed description and the drawings, which are not necessarily to scale, depict illustrative aspects and are not intended to limit the scope of the invention. The illustrative aspects depicted are intended only as exemplary.

Aspects of the disclosure relate to a shaving blade assembly 10 as shown in FIGS. 1 to 4. FIG. 1 is a perspective view of a shaving blade assembly 10. The shaving blade assembly 10 has a hollow housing 20 that may be formed in a rectangular shape, however the housing 20 may have different shapes, for example an oval shape. The housing 20 may also include a cap 20A, guard bar 20B, and a pair of substantially c-shaped retainers 80 each having a top portion, a bottom portion, a substantially convex portion connecting the top and bottom portions, where the retainers 80 are adapted to retain the position of the blades 30 within the housing 20. The retainers may extend along a pair of side edges of the housing 20 and are spaced apart and positioned on opposite sides of the housing 20. The retainers 80 may be either integral with the housing or a separate component assembled with the housing. Additionally, the shape of the retaining means can be either complementary to the shape of a movable member 50A, 50B or not.

Secured within the housing 20 is at least one blade 30. In this embodiment, a plurality of blades 30 are shown, however, it is contemplated that the shaving blade assembly 10 may have any number of blades 30. Additionally, the blades 30 that are shown are elongate in shape; however, it is contemplated that the blades 30 may be formed into any other suitable shape. Each blade 30 has a cutting edge 32 that defines a line and is adapted to cut facial hair or body hair.

The blades 30 traverse the housing 20 between a first end 22 to a second end 24. The blades 30 may be partially exposed through an opening in the housing 20. Each blade 30 has two ends that correspond with the first and second ends of the housing 22, 24. The ends of the blades 30 may be oriented to extend beyond the boundaries of the opening in the housing 20 and be partially covered and unexposed. Additionally, each blade may be one piece, bent to form an angle, or may comprise a blade support attached on it.

Figure 2:
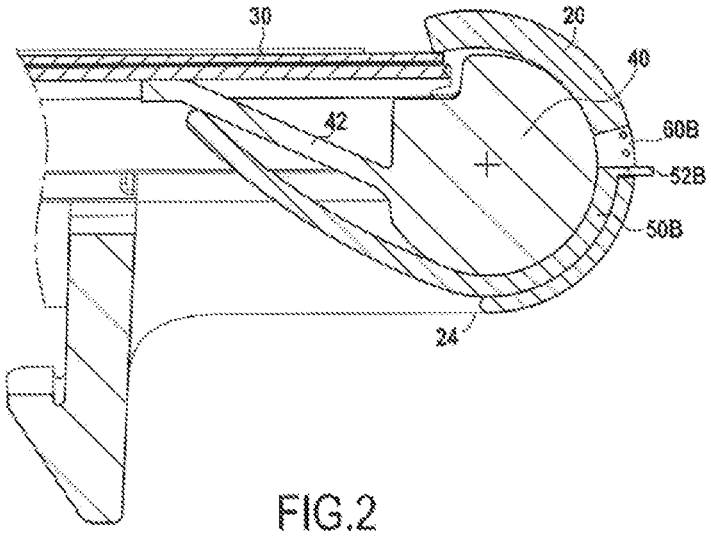
FIG. 2 is a cross-section cut along the plane II-II of the shaving blade assembly of FIG. 1.

Turning to FIG. 2, which is a cross-section along plane II-II in FIG. 1. Encased within the housing 20 is a mounting structure 40 that has a flexible and resilient element 42 extending therefrom. In this concept, the resilient element 42 is an elongate spring finger, however the resilient element 42 can have any other suitable form. The resilient element 42 may be composed of any type of appropriate single or many materials, including, but not limited to: a metal, polymer, or composite material or a combination. Additionally, it is envisioned that in this embodiment two resilient elements 42 are used, each being disposed on respective first and second sides 22, 24; however, it is contemplated that any number of resilient elements 42 may be used.

The resilient element 42 is adapted to contact the underside of blades 30, which is the surface of the blades 30 that is facing the interior of the housing 20. The resilient elements are adapted to contact all of the blades 30. The resilient element 42 is assembled in the housing 20, or may be integral with the housing, with a pre-loaded stress such that the resilient element 42 may be adapted to urge or push the blades 30 in a first direction, specifically orthogonally to the cutting edge of the blade 30, toward the opening in the housing, thereby causing the ends of the blades 30 to contact or abut the housing 20. Orthogonally to the cutting edge of the blade 30 means any direction in a plane P perpendicular to the cutting edge.

A movable member 50B may be disposed within the interior of the housing 20 and may contact the body of resilient element 42. In this embodiment, the shaving blade assembly 10 has two movable members 50A, 50B, one on each side of the shaving blade assembly 22, 24. However, it is contemplated that the shaving blade assembly 10 may have any number of movable members 50A, 50B.

Each movable member 50A, 50B may be formed into an arcuate shape and may be adapted to slide along a corresponding arcuate track within the housing 20 (not shown). Each movable member 50A, 50B defines a lever 52A, 52B that extends outwardly. The housing 20 has corresponding windows 60A, 60B that allow the respective levers 52A, 52B to extend from the inside of the housing 20 to the exterior of the housing 20. Further, the levers 52A, 52B are adapted to be engaged by a user of the shaving blade assembly 10.

In this embodiment, the levers 52A, 52B of the movable members 50A, 50B are disposed on the ends 22, 24 of the shaving blade assembly 10; however, it is contemplated that the levers 52A, 52B may be disposed anywhere on the shaving blade assembly 10, for example, on the top surface, the bottom surface, or any other suitable location.

Figure 3A:
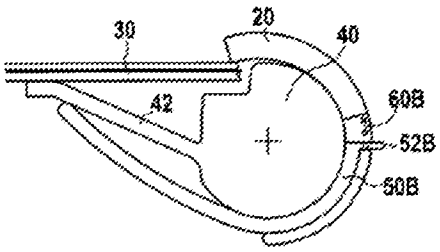
FIG. 3A is a schematic of the shaving blade assembly of FIG. 2 when the movable member is in an initial position.
Figure 3B:
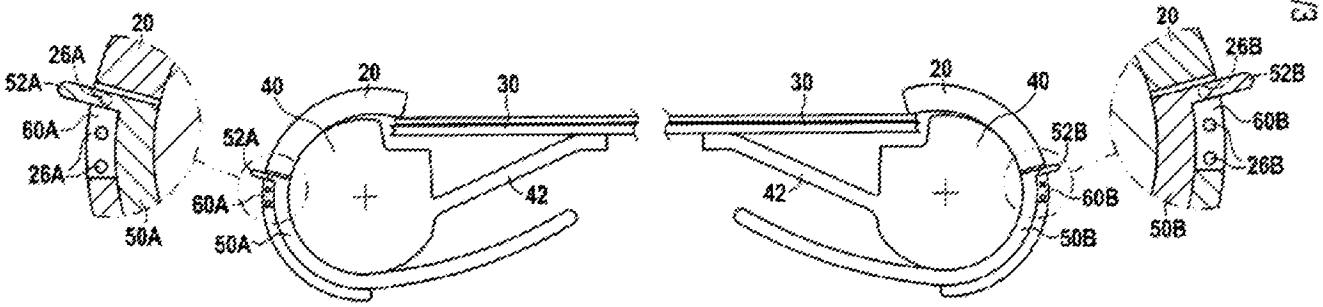
FIG. 3B is a schematic of the shaving blade assembly of FIG. 2 when the movable member is in a final position.

Turning to FIGS. 3A and 3B, the movable member 50B can be secured into place by a securing means 26B. Each movable member 50A, 50B has a respective securing means 26A, 26B that secures or locks the movable members 50A, 50B into the initial position and/or final position. The securing means 26A, 26B may secure the movable members 50A, 50B to not obstruct the free movement or deformation of the resilient member 42 or to be set in a position to prevent the resilient element 42 from moving or flexing beyond a desired point.

For illustrative purposes, only the initial and final positions are discussed, however it is contemplated that the movable member(s) 50A, 50B may be positioned in any number of positions or stages. Each of the securing means positions may allow the resilient members 42 to have a different range or motion relative to a shaving plane. The shaving plane is defined by a tangent line intersecting the top surfaces of the guard bar 20B located on the front side of the housing of the shaving blade assembly and the cap 20A located at the rear side of the housing. The term "exposure" as used herein is intended to mean the perpendicular distance from the cutting edge of a blade to the shaving plane. For a person skilled in the art, the blade exposure is typically considered positive when the blade edge is disposed above this tangent line, effectively extending out of the housing 20, and is considered negative when the blade edge is positioned below this tangent line, inside of the housing 20, at a rest position.

As can be seen in FIG. 3A, the moveable member 50B is in a first, impeding, position where the end of the movable member 50B is contacting the body of the resilient member 42. In this position, when a normal force is applied to the outer surface of the blades 30 in a second direction (toward the inner cavity of the housing 20), which is opposite to the direction that the resilient element 42 is urging the blades 30, the blades 30 may be configured to flex or bend the resilient element 42. However, the movable member 50B is adapted to apply a reaction force on the resilient member 42 restricting the range of motion of the resilient element 42. As a consequence, the moveable member 50B limits the movement or deformation of the resilient element 42, thus causing the blades 30 to have a restricted downwards movement relative to the shaving plane. Thus, in this position the exposure of the blade (30) remains constant during shaving.

In contrast, as shown in FIG. 3B, the moveable member 50B is in a second, open, position where the end of the movable member 50B is away from the body of the resilient member 42. In this position, when a normal force is applied to the outer surface of the blades 30 in a second direction, the blades 30 are configured to freely flex or bend the resilient element 42. In both of the aforementioned circumstances, when the force applied to the blades 30 is alleviated, the resilient element 42 urges the blades 30 in the first direction and against the housing 20. Further, the distance between the first initial and second final position defines an allowable range of movement of the resilient element 42. When the end of the moveable member 50B is at its final second position and a normal force is applied to the outer surface of the blades, the blades 30 among with the resilient element 42 are moving downwardly relatively to the shaving plane. As a consequence, the position of the blades is lower compared to the position when the end of the moveable member 50B is at the first position. The possibility of choosing the position of the end of the moveable member 50B allows the adjustment of the position of the blades during shaving.

It is contemplated that any suitable securing means 26A, 26B may be implemented to secure the movable members 50A, 50B into place, including, but not limited to: a spring loaded ball-lock pin and corresponding recesses, a protrusion and matching cavities, or a frictional contact between the movable members 50 and the corresponding windows 60A, 60B of the housing 20. It is also contemplated that either one of the corresponding movable members 50A, 50B or windows 60A, 60B can have the ball lock/protrusion or cavities. For example, movable member 50B may have a protrusion and corresponding window 60B may have a cavity, or vice versa.

In the embodiment that has two movable members 50A, 50B on opposing sides of the shaving blade assembly 22, 24, the user should adjust each of the movable members 50A, 50B to be at the same securing position to achieve a uniform cutting performance. Adjusting the securing position can be done easily by applying pressure on the levers 52A, 52B of the movable members 50A, 50B, for example, a user can toggle each lever with their finger, to dislodge the securing means 42A, 42B and adjust the range of motion of the resilient element 42.

If a user desires to have a closer and more bold shave, they can adjust the levers 52A, 52B such that the blades 30 are effectively fixed. However, if a user desires a more sensitive and less bold shave, they can adjust the levers 52A, 52B to allow the resilient members 42 to move more freely.

Figure 4:
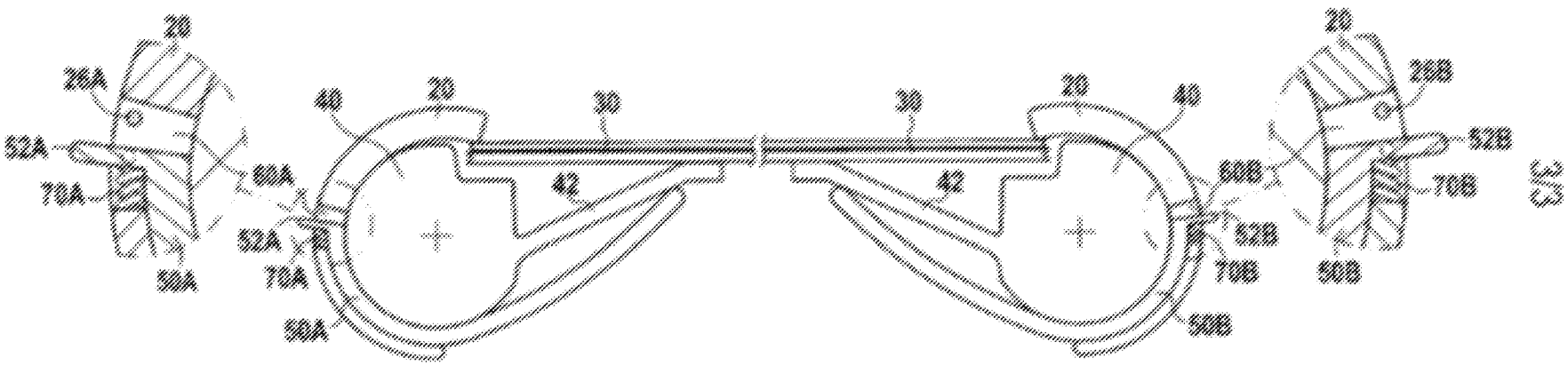
FIG. 4 is a cross-section of an alternative embodiment of the shaving blade assembly.

FIG. 4 shows an alternative embodiment similar to the first embodiment of FIGS. 1-3. As such, discussion of similar elements having the same reference numerals will be omitted. In the alternative embodiment presented, stiffening members 70A, 70B are disposed in respective windows 60A, 60B of the shaving blade assembly 10. The stiffening members 70A, 70B may be adapted to interact with the movable members 50A, 50B and the housing 20. The stiffening members may be and interposed between the levers 52A, 52B of the movable members 50A, 50B and the housing 20, inside of the windows 60A, 60B. It is envisioned that the stiffening members 70A, 70B can be a spring, but any other suitable stiffening members can be used. The stiffening members 70A, 70B are adapted to push the movable members 50A, 50B to be in continuous contact with the resilient member 42.

In operation, when a normal force is applied to the outer surface of the blades 30 in a second direction (toward the inner cavity of the housing 20), which is opposite to the direction that the resilient element 42 is urging the blades 30, the blades 30 may be configured to flex or bend the resilient element 42. However, the combination of the movable member 50B and stiffening members 70A, 70B may be adapted to apply a reaction force on the resilient member 42 making it harder to achieve the same range of motion the resilient element 42 has when it is not in contact with the movable members 50A, 50B. Thus, increasing the stiffness k decreases the motion of the resilient member 42 in response to the shaving pressure, resulting in an aggressive shave; while decreasing the stiffness k increases the motion of the resilient member 42 in response to the shaving pressure, resulting in a more sensitive shave. As in the first embodiment, the shaving blade assembly 10 may further comprise securing means 26B to selectively hold each movable member 50A, 50B in at least one position, and in particular, in a position analogous to that illustrated in FIG. 3B, so that the ends of the movable members 50A, 50B are held out of contact with the resilient elements 42, and the resilient elements 42 can thus freely flex or bend under the blades 30, without being stiffened by the stiffening members 70.

It is envisioned that the stiffening members can be interchangeable. For example, if a user desires a more bold shave, they can insert a stiffening members with a high stiffness k. However, if the user desires to have a less bold shave, or for that matter, a sensitive shave, they may be able to remove or replace the stiffening members 70A, 70B with ones that have a lower stiffness k. In this embodiment the position of the blades 30 is variable during the shaving, since the hardness of the stiffening members 70A, 70B is the feature that defines the downward movement of the blades relatively to the shaving plane.

It is also contemplated that the shaving blade assembly 10 is adapted to attach to a razor handle and maybe interchangeable, for example, when the blades become dull or damaged. However, it is also contemplated that the shaving blade assembly may be formed monolithically with a razor handle and can be used as a disposable razor.

Throughout the description, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Although the present disclosure herein has been described with reference to particular embodiments, it is to be understood that these embodiments are merely illustrative of the principles and applications of the present disclosure.

It is intended that the specification and examples be considered as exemplary only, with a true scope of the disclosure being indicated by the following claims.

The invention claimed is:

1. A shaving blade assembly, comprising:

one or more blades, a first resilient element supporting the blade and arranged to urge the blade in a first direction substantially orthogonal to a cutting edge of the blade; and a first movable member, wherein the first movable member is configured to selectively engage the first resilient element in the first direction, in at least one position, to limit deformation of the first resilient element.

2. The shaving blade assembly of claim 1, further comprising a plurality of resilient elements each supporting at least one blade among the one or more blades, wherein the plurality of resilient elements includes the first resilient element.

3. The shaving blade assembly of claim 1, wherein the first movable member is configured to be selectively held in the at least one position.

4. The shaving blade assembly of claim 1, wherein the first movable member is configured to be securable in a plurality of different positions, the plurality of different positions including the at least one position.

5. The shaving blade assembly of claim 1, wherein the first movable member is configured to be secured by friction in the at least one position.

6. The shaving blade assembly of claim 1, further comprising a stiffening member configured to urge the first movable member against the first resilient element.

7. The shaving blade assembly of claim 6, wherein the stiffening member is removably attached to the first movable member.

8. The shaving blade assembly of claim 1, further comprising a second movable member and a second resilient element, wherein:

the blade extends between the first movable member and the second movable member, and the second movable member is configured to engage the second resilient element in the first direction to limit movement of the second resilient element.

9. The shaving blade assembly of claim 1, wherein the first movable member comprises a substantially arcuate segment.

10. The shaving blade assembly of claim 1, wherein the first resilient element is bendable.

11. The shaving blade assembly of claim 1, further comprising:

a housing to support the one or more blades and the first resilient element, and a stiffening member configured to urge the first movable member against the first resilient element.

12. The shaving blade assembly of claim 11, wherein the stiffening member is removably attached to at least one of the first movable member or the housing.

13. The shaving blade assembly of claim 1, further comprising:

a second resilient element supporting the one or more blades and arranged to urge the one or more blades in the first direction; and a second movable member, wherein the second movable member is configured to selectively engage the second resilient element in the first direction, in at least one position, to substantially impede deformation of the second resilient element.

14. The shaving blade assembly of claim 1, further comprising a housing to support the blade and the first resilient element, wherein the housing includes a window through which at least a portion of the first movable member outwardly extends.

15. The shaving blade assembly of claim 14, wherein the housing includes a C-shaped retainer, and the C-shaped retainer includes the window.

16. The shaving blade assembly of claim 1, wherein the first movable member includes a lever.

17. The shaving blade assembly of claim 1, further comprising a second movable member and a second resilient element, wherein the second movable member is configured to engage the second resilient element in the first direction to limit movement of the second resilient element.

18. A shaving blade assembly comprising:

a plurality of blades, a resilient element supporting the plurality of blades, the first resilient element being arranged to urge the blade in a first direction substantially orthogonal to a cutting edge of the blade; and a movable member, wherein the movable member is configured to selectively engage the resilient element in the first direction, in at least one position, to substantially impede deformation of the resilient element.

19. A method of adjusting a shaving blade assembly, wherein the shaving blade assembly comprises a blade supported by a resilient element configured to urge the blade in a first direction substantially orthogonal to a cutting edge of the blade; and a movable member configured to move between a first position and a second position and configured to engage, at the second position, the resilient element in the first direction to limit movement of the resilient element, wherein the method includes:

moving the movable member between the first position and the second position in either one of a first movable member direction corresponding to the first direction in which the blade is urged or a second movable member direction corresponding to a second direction in which the blade flexes.

20. The method of claim 19, wherein the movable member is configured to move along an arcuate path when being moved between the first and second positions.

* * * * *